United States Patent [19]

Wactor

[11] 4,077,065

[45] Mar. 7, 1978

[54] BODY GARMENT

[76] Inventor: Gerald E. Wactor, 884 Harned St., Perth Amboy, N.J. 08861

[21] Appl. No.: 701,539

[22] Filed: Jul. 1, 1976

[51] Int. Cl.[2] ..... A41D 1/00

[52] U.S. Cl. ..... 2/93

[58] Field of Search ..... 2/95, 90, 139, 100, 2/98; D2/184

[56] References Cited

U.S. PATENT DOCUMENTS

| | | | |
|---|---|---|---|
| 1,691,717 | 11/1928 | Hofer | 2/93 |
| 1,817,302 | 8/1931 | Einbinder | 2/95 |
| 2,055,802 | 9/1936 | Prins | 2/98 |
| 2,138,041 | 11/1938 | Preston | 2/98 |
| 2,643,385 | 6/1953 | Engel | 2/93 |

FOREIGN PATENT DOCUMENTS

| | | | |
|---|---|---|---|
| 1,344,131 | 10/1963 | France | 2/98 |

*Primary Examiner*—Doris L. Troutman
*Attorney, Agent, or Firm*—Paul J. Sutton

[57] ABSTRACT

The present invention provides a garment system for providing the user with an array of different garment styles, utilizing a minimum of pieces of apparel, comprising a garment body portion which encircles the body of the wearer and is provided with a means of detachably securing a lapel piece to the body portion for forming a unitary body garment. The garment body portion may be a vest, suit coat, sport jacket or tuxedo whose styling may be changed by fitting a variety of lapel styles and colors.

1 Claim, 12 Drawing Figures

BODY GARMENT

This invention relates generally to apparel garments and the like. In particular, this invention presents an improved body garment wherein a portion of the garment is detachably secured thereto and may be changed as desired by a wearer of the body garment.

Many efforts to solve this problem have been made and are known to the art. A search of U.S. Patent Office records will show a host of prior art patents which attempt to solve the problem of body garment styling.

Let us now look at certain prior art patents which, while not anticipatory of the present invention, disclose representative examples of previous or known efforts to solve some of the problems associated with the art embodying this invention.

U.S. Pat. No. 2,721,328 to Rosenbaum is a recent attempt to provide economy and styling in a body garment. Rosenbaum's patent provides for a jacket section 10 having a collar 30 secured thereto, the combination providing the wearer with a jacket appearing to have a shirt under the jacket. Rosenbaum's patent does not provide for detachably securing collar 30 to jacket 10 which would enable a variety of shirt styles to be worn.

Bryant's U.S. Pat. No. 2,306,154 represents another attempt to provide economy and styling in a body garment. Bryant utilizes a main outer body portion 10, conforming generally to the appearance of a coat, and a permanently attached portion 11, which simulates the front portion of a shirt. Bryant's drawings show several shirt fronts of different style which can be permanently attached to outer body portion 10. This patent does not provide for detachably securing portion 11 to outer body portion 10.

U.S. Pat. No. 2,276,775 to Newton represents still another attempt to provide economy and styling in a body garment. Newton provides for a shirt 5 to which is permanently attached a collar 9. Shirt 5 can be converted from dress to sport wear by turning collar 9 into and under the shirt 5. Newton's patent does not provide for detachably securing collar 9 to shirt 5 and thereby providing a variety of collar styles.

Carey and Bischof's U.S. Pat. No. 2,119,040 represents yet another attempt to provide economy and styling in a body garment. Carey and Bischof provide an apparel — garment of jacket type A provided with a plurality of co-operable fastening elements such as buttons 5 for releasable engagement with a combined collar and shirt section B. This patent provides for detachably securing combined collar and shirt B with apparel — garment of jacket type A utilizing buttons and complementary button holes.

While I do not wish to minimize the inventiveness and efforts of the inventors associated with the aforesaid prior patents, and while these people may be attempting to solve a problem that is similar to some of the problems solved by the present invention, it is worth mentioning some of the drawbacks of these apparel — garments. In general there is no provision for easy and convenient detaching of the collar containing pieces from the body garment portion. In all but the last of the foregoing prior patents the inventors did not recognize the desirability of detachable collar containing pieces. The last of the prior patents has a detachable collar containing piece which is made detachable so as to be comfortable to the wearer.

Accordingly it is an object of the present invention to provide a body garment which has detachably secured a lapel piece.

Another object of this invention is to provide a body garment whose style may be altered by detachably securing a series of differently styled lapel pieces.

Yet another object of this invention is to provide a wearer with an economical body garment.

A further object of this invention is to provide a body garment of the jacket type.

Still another object of this invention is to provide a body garment of the vest type.

Still yet another object of this invention is to provide a body garment which has detachably secured a reversible lapel piece.

My invention will be made more clearly understood from the following description of specific embodiments of the invention, together with the accompanying drawings, wherein similar reference characters denote similar elements throughout the several views and in which.

Figure 1:
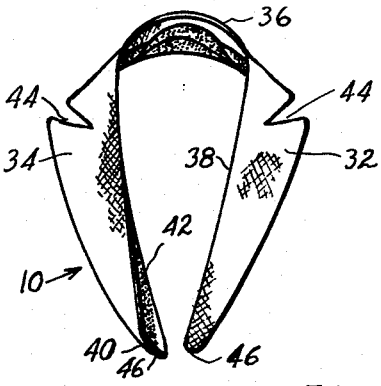
FIG. 1 is a front view of a lapel piece.

Referring to the drawings in more detail, FIG. 1 illustrates an interchangeable notched lapel pice 10 comprising a left lapel section 32 having a notch 44 integral with a collar section 36 which collar section 36 is also integral with a right lapel section 34 having notch 44. Integral with left and right lapel sections 32, 34 and collar section 36 is a folded strip 40 having a first fold 38 coinciding with an inside margin.

Left lapel section 32 and right lapel section 34 each have at their extreme lower portion a tapered end portion 46. First fold 38 and folded strip 40 are contiguous from the extreme lower portion of right lapel section 34 to the extreme lower portion of left lapel section 32.

Integral with an inside surface of folded strip 40 is a strip 42 formed of a loop pile fastener type of fastener such as what is known commercially as "Velcro" or the like. The term "Velcro" is used to denote a class of separable cohering materials in common use for demountably securing portions of body — garments and the like.

Figure 2:
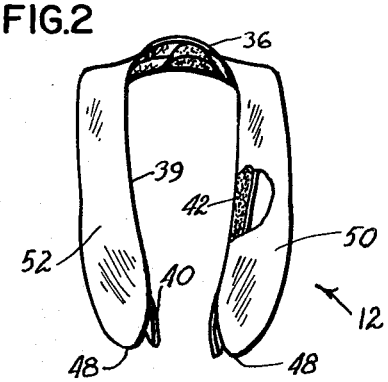
FIG. 2 is a front view with cutaway section of another lapel piece.

In FIG. 2 is shown an interchangeable continuous lapel piece 12 comprising a continuous left lapel section 50 integral with collar section 36 further integral with a continuous right lapel section 52. Integral with continuous left and right sections 50, 52 and collar section 36 is folded strip 40 having a second fold 39 which does not coincide with the inside margin in its entirety.

Continuous left lapel section 50 and right lapel section 52 each have at their extreme lower portion a rounded end portion 48. Second fold 39 is not contiguous with the inside margin portions of rounded end portion 48.

Integral with the inner surface of folded strip 40 is strip 42.

Figure 3:
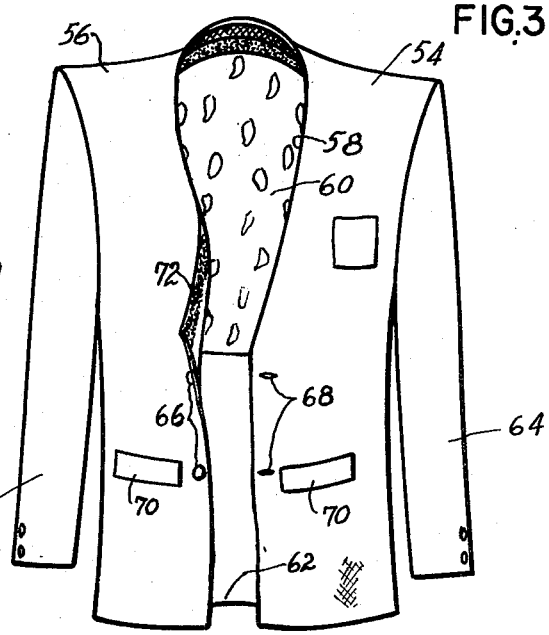
FIG. 3 is a front view of a jacket.

FIG. 3 illustrates a jacket 14 which comprises a jacket back section 62 joined to a jacket left front section 54 and a jacket right front section at the usual side and top seams. A jacket sleeve 64 is joined to each side to complete jacket 14. To make jacket 14 wearable, jacket buttons 66, complementary jacket button holes 68, jacket pocket flaps 70 and lining 60 are provided.

Jacket 14 has a jacket neck margin 58 having integral with its inner face a jacket fastening strip 72. Jacket strip 72 is adapted to be co-operative with and separably cohere to strip 42.

Figure 4:
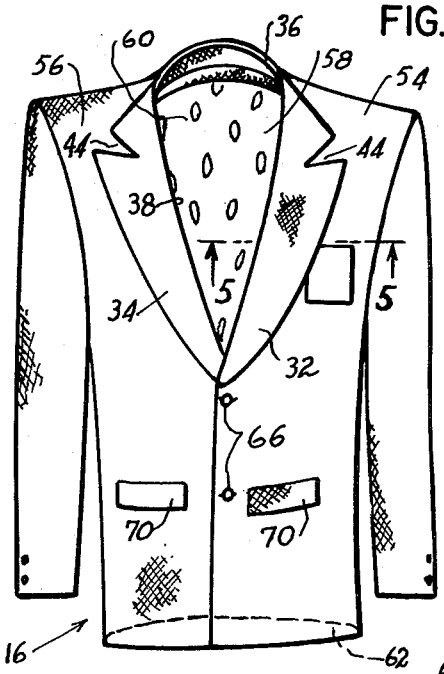
FIG. 4 is a front view of jacket with lapel piece integral.

A jacket with lapel piece integral 16 is illustrated in FIG. 4 and comprises jacket 14 and notched lapel piece 10 made integral. When jacket 14 and notched lapel piece 10 are in alignment first fold 36 is contiguous with jacket neck margin 58.

Figure 5:
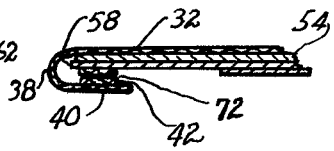
FIG. 5 is a sectional view taken on line 5—5 of FIG. 4.

FIG. 5 being taken along line 5—5 of FIG. 4 best illustrates the foregoing in that jacket strip 72 is shown abutting and cohering with strip 42. The relationship between first fold 38 and jacket neck margin 58 is also shown.

Figure 6:
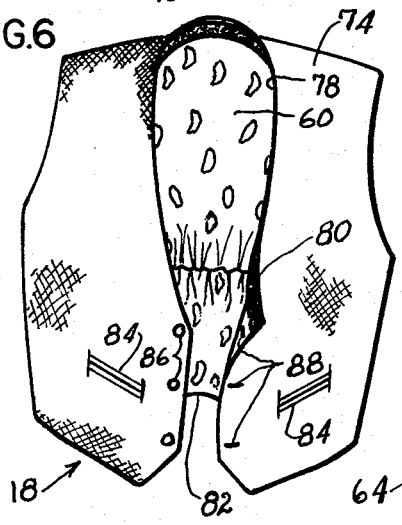
FIG. 6 is a front view of a vest.

Illustrated in FIG. 6 is a vest 18 which comrises a vest back section 82 joined to a vest left front section 74 and a vest right front section 76 at the usual side and seams. To make vest 18 wearable, vest buttons 86, complementary vest button holes 88, vest pockets 84 and lining 60 are provided.

Vest 18 has a vest neck margin 78 having integral with its inner face a vest fastening strip 80. Vest strip 80 is adapted to be co-operative with and to separably cohere to Velcro strip 42.

Figure 7:
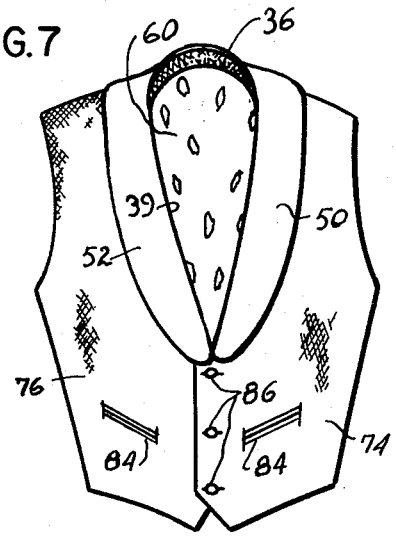
FIG. 7 is a front view of vest with lapel piece integral.

In FIG. 7 is shown an interchangeable vest with continuous lapel piece integral comprising vest 18 and continuous lapel piece 12 made integral. When vest 18 and continuous lapel piece 12 are in alignment, second fold 39 is contiguous with vest neck margin 58.

Cooperation between strip 42 and vest Velcro strip 80 is similar to that described for the foregoing FIG. 5.

Figure 8:
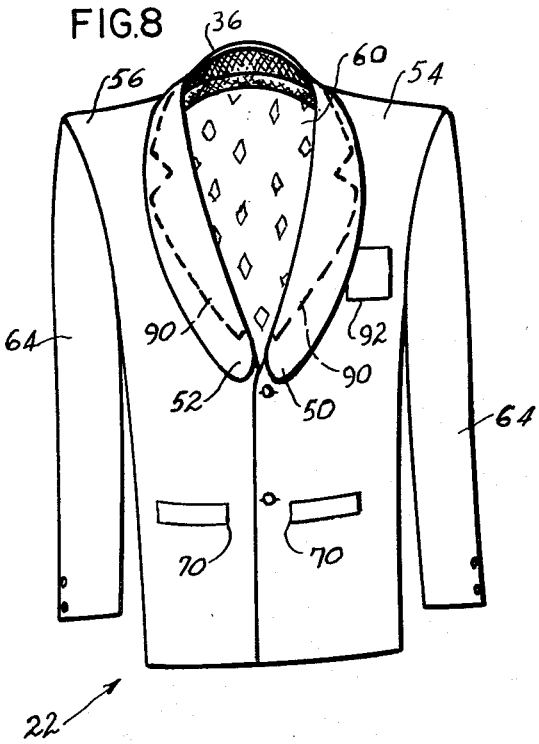
FIG. 8 is a front view of jacket having lapels with lapel piece superposed.

FIG. 8 illustrates a jacket having lapels with continuous lapel piece integral 22 consisting of jacket 14 and interchangeable continuous lapel piece 12 made integral. For this illustration a jacket 14 has joined at jacket neck margin 58 a pair of first lapels 90 and a breast pocket 92 to form what is generally accepted as a suit jacket or sport jacket. Interchangeable lapel piece 12 is then superposed on lapels 90 and second fold 39 is contiguous with jacket neck margin 58.

Figure 9:
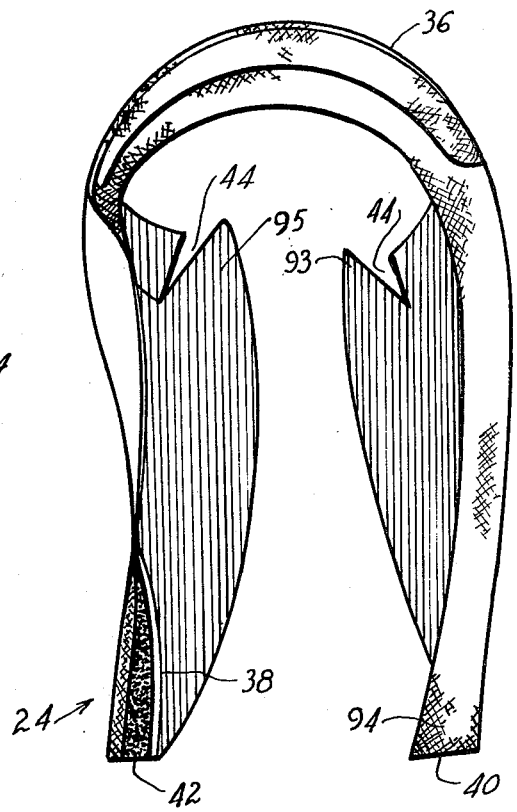
FIG. 9 is a cutaway view of a lapel piece with reversible lapels.

Illustrated in FIG. 9 is an interchangeable lapel piece with reversible lapels 24 which comprises a reversible left lapel section 93 having a notch 44 integral with collar section 36 further integral with a reversible right lapel section 95 having notch 44. Integral with reversible left and right lapel sections 93, 95 and collar section 36 is folded strip 40 having a first fold 38.

Integral with the inside surface of folded strip 40 is strip 42 and in addition a reverse fastening strip 94 is made integral with the surface opposite the inside surface of folded strip 40.

Figure 10:
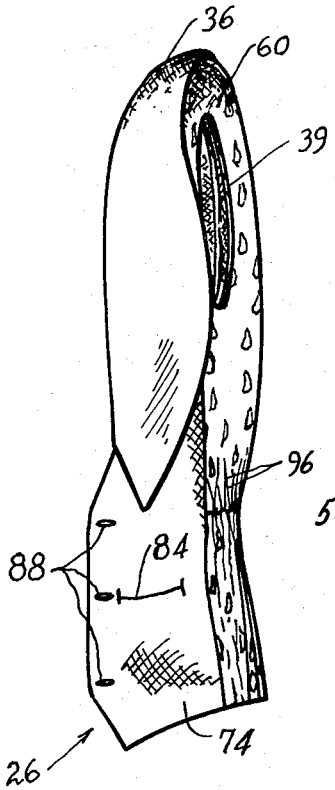
FIG. 10 is a side view of a vest with an elastic back band with lapel piece integral.

FIG. 10 shows a vest with elastic back band and interchangeable lapel piece integral 30 comprised of vest left section 74 and vest right section 76 joined together by a vest elastic back band 96. Disposed on vest 18 with elastic back band 96 is continuous interchangeable lapel piece 12.

Figure 11:
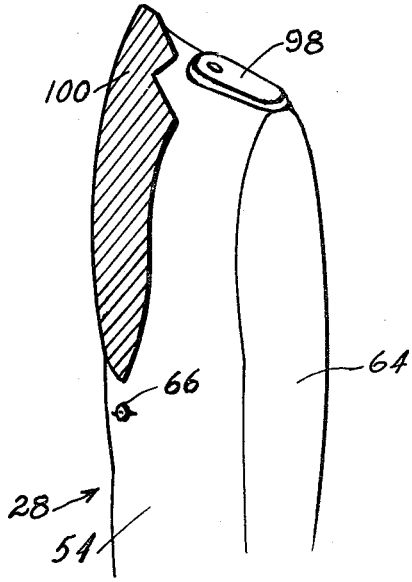
FIG. 11 is a partial perspective view of still another jacket and lapel piece integral.

FIG. 11 illustrates still another jacket and interchangeable lapel piece integral 28 comprising jacket 14 with an epaulet 98 added to the shoulder and still another lapel piece 100 made integral with jacket 14.

Figure 12:
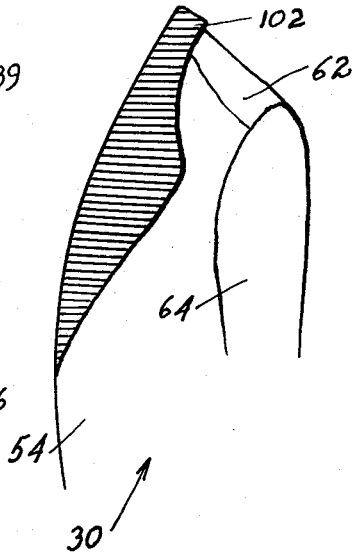
FIG. 12 is a partial perspective view of yet another jacket and lapel piece integral.

FIG. 12 further illustrates yet another jacket and interchangeable lapel piece integral 30 which comprises yet another lapel piece 102 integral with jacket 14.

The notched interchangeable lapel piece 10 is a portion of my invention which may be made cooperative with jacket 14, another portion of my invention, to result in the jacket with interchangeable lapel piece integral 16.

It will be perceived that a wearer possessing but a single jacket 14 may have several notched interchangeable lapel pieces 10, each notched interchangeable lapel piece 10 having a decorative outer surface which complements the outer surface of jacket 14. The variety of notched interchangeable lapel pieces 10 enables the wearer to have a variety of combinations available to him. It is also contemplated to combine continuous interchangeable lapel piece 12 with jacket 14.

Placement of interchangeable lapel piece 10 over jacket 14 so that jacket neck margin 58 coincides with first fold 38 will ensure that strip 42 is in alignment with jacket strip 72. The wearer can then manipulate folded strip 40 to permit strip 42 to contact jacket Velcro strip 72 as shown in FIG. 5 and detachably secure interchangeable lapel piece 10 and jacket 14 operably together.

Continuous interchangeable lapel piece 12 differs from notched interchangeable lapel piece 10 in that second fold 39 does not coincide with the inside margin in its entirety thereby enabling rounded end portions 48 a movement independent of the end portions of strip 42.

Continuous interchangeable lapel piece 12 is combined with vest 18 in a manner similar to the foregoing description for jacket with interchangeable lapel piece integral 16 and results in vest with continuous interchangeable lapel piece integral 20.

FIG. 7 shows as a dotted line a portion of vest left front section 74 passing between vest right front section 76 and rounded end portion 48 of continuous interchangeable right lapel section 52 as described in a previous paragraph.

FIG. 8 illustrates a jacket having first lapels with interchangeable lapel piece integral 22 wherein continuous interchangeable lapel piece 12 has a satin outer surface. The application of a satin surfaced interchangeable lapel piece 12 to a sport or suit jacket may result in a tuxedo jacket.

Interchangeable lapel piece with reversible lapels 24 is another embodiment of my invention. Here the wearer having a single interchangeable lapel piece with reversible lapels 24 can effect a further economy by having two decorative surfaces available to him.

Vest with elastic back band and interchangeable lapel piece integral 26 has the advantage, unlike other vests, of fitting a range of different sized wearers. This desirable effect is obtained by the use of vest elastic back band 96 which will accommodate different sized wearers by expanding.

The embodiment of the invention particularly disclosed and described hereinabove is presented merely as an example of the invention. Other embodiments, forms and modifications of the invention coming within the proper scope and spirit of the appended claims will, of course, readily suggest themselves to those skilled in the art.

What is claimed is:

1. A body garment system usable with trousers and capable of combined use as a suit, a tuxedo, and a non-matched sport outfit, comprising, in combination: at least one jacket having a lapel-receiving portion; at least one vest having a lapel-receiving portion; at least one reversible lapel formed with a first pattern on one side thereof and a second pattern on the opposite side thereof, said reversible lapel comprising means for co-operatively mounting said lapel on either of said vest lapel-receiving or said jacket lapel-receiving portions with either of said first or second patterns exhibited; said body garment system comprising a non-vested suit when comprising said trousers, said jacket and said jacket-mounted lapel all exhibiting a common pattern; said body garment system comprising a vested suit when comprising said trousers plus said jacket plus said vest plus said vest-mounted lapel all exhibiting a common pattern; said body garment system comprising a tuxedo when comprising said trousers plus said jacket plus said vest plus said vest-mounted lapel with said lapel exhibiting a satin pattern; said body garment system comprising a non-jacket sport outfit when comprising said trousers plus said vest plus said vest-mounted lapel; said body garment system comprising a non-vested jacketed sport outfit when comprising said trousers plus said jacket plus said jacket-mounted lapel all exhibiting complimentary but an uncommon pattern; and said body garment system comprising a vested jacketed sport outfit when comprising said trousers plus said vest plus said jacket plus said vest-mounted lapel all exhibiting complimentary but an uncommon pattern.

* * * * *